United States Patent [19]

Di Gregorio

[11] Patent Number: 4,522,404

[45] Date of Patent: Jun. 11, 1985

[54] SUBDIVIDED BLOCK COMPONENTS REASSEMBLABLE INTO THREE DIMENSIONAL FIGURES

[76] Inventor: Vincenzo Di Gregorio, Via Alta Del Poggio, 6, 22050 - Montevecchia - (COMO), Italy

[21] Appl. No.: 620,843

[22] Filed: Jun. 14, 1984

[51] Int. Cl.[3] ..... A63F 9/12

[52] U.S. Cl. ..... 273/157 R; 434/211; 446/124

[58] Field of Search ..... 273/157 R; 434/211; 446/124

[56] References Cited

U.S. PATENT DOCUMENTS

| | | | |
|---|---|---|---|
| 907,203 | 12/1908 | Walker | 273/157 R |
| 1,565,099 | 12/1925 | Nierodka | 273/157 R |
| 4,317,563 | 3/1982 | Wahl | 434/211 |
| 4,317,654 | 3/1982 | Wahl | 434/211 |
| 4,334,870 | 6/1982 | Roane | 434/211 |

FOREIGN PATENT DOCUMENTS

| | | | |
|---|---|---|---|
| 12430A | 2/1981 | Italy . | |
| 396512 | 8/1933 | United Kingdom | 446/124 |
| 429509 | 5/1935 | United Kingdom | 273/157 R |

*Primary Examiner*—Anton O. Oechsle
*Attorney, Agent, or Firm*—Browdy and Neimark

[57] ABSTRACT

The invention is concerned with the technical field of structures adapted to provide entertainment of a didactic character, and in particular with a block subdivided into suitable portions to compose three-dimensional figures. The technical problem to be solved was that of providing a simple structure whereby a very high number of three-dimensional configurations could be obtained, the elements which make up the game being in such mutual relationship as to favor the attainment of such three-dimensional configurations. The problem is solved by a didactic game defined by a cubic block subdivided into portions which comprise two first prismatic bodies defined by right prisms having isosceles right triangle bases and a combined volume equal to one half that of said block, a parallelepipedon-like inner body with square bases, and second prismatic bodies defined by eight prisms with isosceles right triangle bases and being separated into complementary bodies, defining together with said inner body the form of said first prismatic body, and auxiliary bodies which are identical to one another and together define the form of a further first prismatic body.

13 Claims, 12 Drawing Figures

SUBDIVIDED BLOCK COMPONENTS REASSEMBLABLE INTO THREE DIMENSIONAL FIGURES

BACKGROUND OF THE INVENTION

This invention relates to a didactic game defined by a block subdivided into suitable portions to compose three-dimensional figures.

Known is the idea of subdividing geometric figures into several suitable portions or elements which are adapted, when reassembled together, to form different figures from the original ones. Didactic games of this type have the virtue of stimulating one's ability to invent new forms not always related to readily recognizable natural forms, and to set forth complex forms in a few lines.

In this respect, a Chinese game called "Tangram" is popularly known which comprises a square which can be split into seven geometric forms; from these basic geometric forms, various planar forms can be imitated or created which utilize all of the available elements.

This prior game structure, as well as other comparable ones which are based on the principle of subdividing two-dimensional geometric figures, have the disadvantage of only affording a relatively small number of two-dimensional geometric figures, and above all, lack volume. The latter is an indispensable feature if the feeling for space of the player is to be developed, feeling for space referring herein to the ability to visualize in space objects of various description and of figuring how a given configuration can be modified by merely displacing one or more basic elements thereof.

The Applicant is aware of an Italian Patent Application, No. 12430 A/81, filed by Ta-Kai Chen, which discloses a three-dimensional "Tangram" including a traditional two-dimensional "Tangram" mounted on backplates which merely hold the elements to be composed together raised, while alternatively permitting such elements to be assembled on vertical planes. It is apparent that this known structure cannot obviate the above-mentioned disadvantages of purely two-dimensional didactic games, since the elements to be put together would still define planar figures, albeit tilted up or set vertically.

Also known are U.S. Pat. Nos. 4,317,653 and 4,317,654, both to Martha S Wahl. These patents describe didactic blocks which can be disassembled into various geometric figures. However, these geometric figures are substantially unsuited to the construction of configurations in any way related to natural forms. In fact, the object of said patents is to provide blocks which are adapted to illustrate the form and volume relationships of various geometric figures to facilitate understanding thereof.

SUMMARY OF THE INVENTION

It is now a primary object of this invention to provide a didactic game having a simple structure and being composed of a reduced number of portions whereby a very high number of three-dimensional configurations may be formed.

A further object of the invention is to provide a didactic game wherein said portions are configured, as to shape and dimensions, to facilitate formation of such three-dimensional configurations.

Another object of this invention is to provide a didactic game which is so configured as to enable formation of both simple and complex figures, thereby it can meet the requirements of a range of users.

These objects are accomplished essentially by a didactic game defined by a block subdivided into suitable portions to compose three-dimensional figures, which is characterized in that said block is generally fashioned after a quadrangular prism having for its bases equal-sided parallelograms, and in that said portions comprise: first prismatic bodies identical to one another and defining together a volume at least close to one half the volume of said block and being configured as right prisms having isosceles triangle bases, said first prismatic bodies being bounded by the outer surface of said block, a first section plane containing two opposed corner edges of the lateral surface of said quadrangular prism, and at least one second section plane extending perpendicular to said corner edges and parallel to said isosceles triangle bases, second prismatic bodies fashioned as right prisms with triangular bases extending parallel to the bases of said first prismatic bodies and to a height equal to or being a submultiple of the height of each of said first prismatic bodies, and at least one inner body in the form of a right parallelepipedon having rectangular bases extending parallel to the bases of said first prismatic bodies and the same height as each of said first prismatic bodies, said inner body having a lateral face lying on said first section plane and the lateral corner edges of the opposed lateral face lying on the surface of said block.

BRIEF DESCRIPTION OF THE DRAWINGS

Further features and advantages will be more clearly understood from the following description of some embodiments of the didactic game according to the invention, and in particular of a preferred embodiment thereof illustrated by the accompanying drawings, where.

DESCRIPTION OF THE PREFERRED EMBODIMENTS

Figure 1:
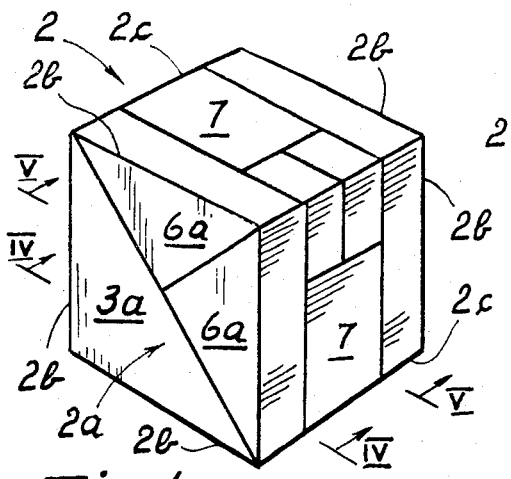
FIGS. 1 and 2 show in perspective from different viewpoints this didactic game as a whole and in its assembled condition to define a solid block.
Figure 2:
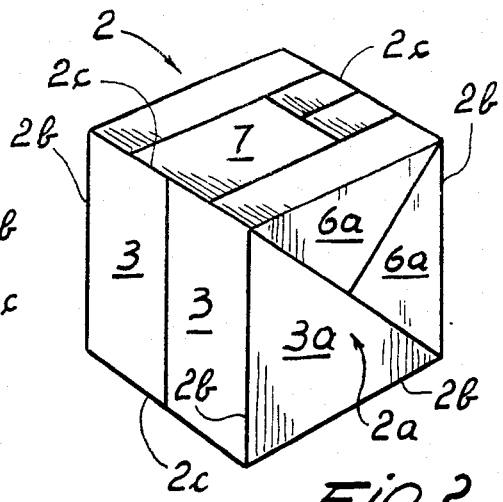

Making reference to the drawing views, and in particularly to FIGS. 1 to 5, a didactic game according to the invention essentially comprises a plurality of portions 1 defining a solid block 2. The latter, in the preferred embodiment of the invention, is generally configured as a cube having square bases 2*a* and sides 2*b* with the same height as the corner edges 2*c* of the lateral surface of said cube.

Further embodiments of the game may provide for the block 2 to be a simple quadrangular prism having bases 2*a* configured as parallelograms or lozenges with equal sides 2*b*. Said quadrangular prism, whether a right or oblique prism, may have any desired height.

In the preferred embodiment shown in the drawings, the block 2 of cubic shape is subdivided into eleven portions including first prismatic bodies 3, second prismatic bodies 5,6, and an inner body 4.

The first prismatic bodies 3 are two right prisms having bases 3*a* defined by isosceles right triangles the catheti whereof, indicated at 3*b*, coincide with the sides 2*b* of the block 2. The first prismatic bodies 3, which have equal lateral corner edges or heights 3*c*, have a combined volume which is equal to one half the volume of the block 2. They are bounded by the outer surface of the block 2, a first section plane through the block 2 containing two opposed corner edges 2*c* of the lateral surface of the block 2, and a second section plane perpendicular to said corner edges and parallel to the bases 3*a*. In practice, said second section plane will separate the two first prismatic bodies 3 identical to one another.

In other embodiments of the invention, it is contemplated that the first prismatic bodies 3, while again in the shape of right prisms and identical to one another, may have bases 3*a* defined by simple isosceles triangles. Furthermore, the first prismatic bodies 3 may be provided in any desired number, even if, of preference, such as to define in all cases a combined volume at least close to one half the volume of the block 2. In the instance of the block 2 being fashioned as a non-right prism, the first, right, prismatic bodies 3*a* would be unable to cooperate in defining the bases 2*a* of the block 2, thereby the bases 2*a* would be formed by additional elements of any desired types.

Figure 3:
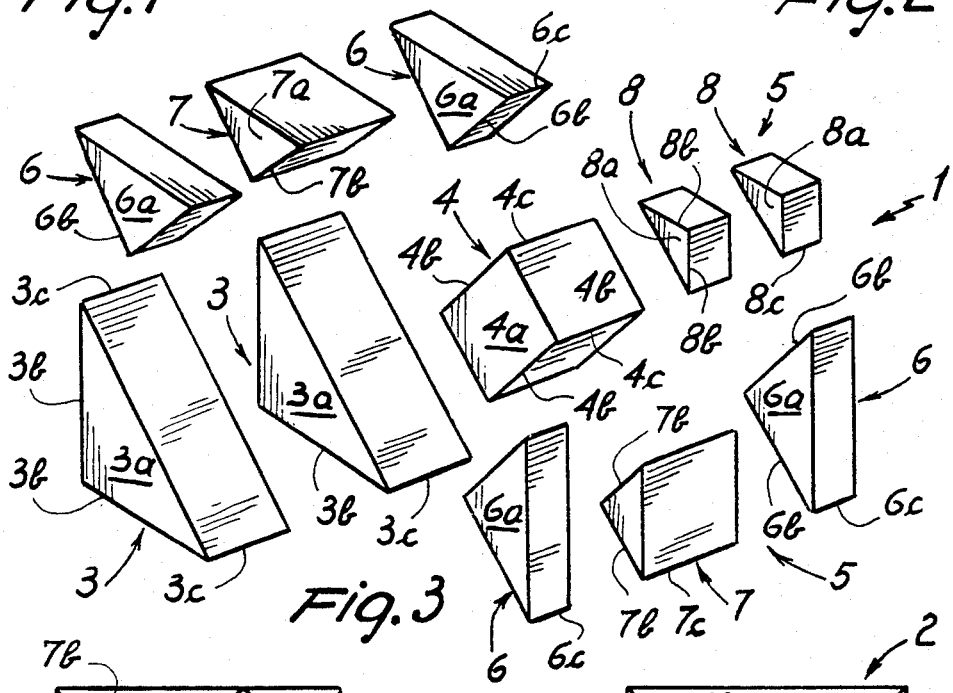
FIG. 3 is an exploded perspective view of the various portions making up the block of FIG. 1.
Figure 4:
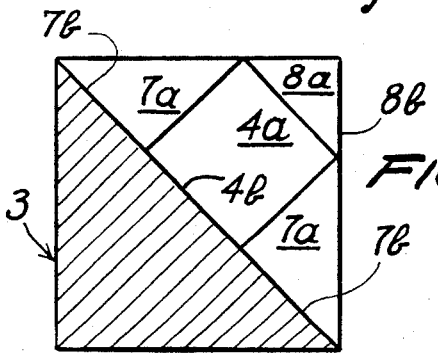
FIGS. 4 and 5 are two sectional views, in elevation, of the block of FIG. 1, as taken along the lines IV—IV and V—V, respectively.

One portion 1 of the block 2 is defined by the inner body 4 comprising, in the preferred embodiment shown in FIGS. 3 and 4, a right parallelepipedon whose bases 4*a* are defined by squares and extend parallel to the bases of the first prismatic bodies 3. The sides 4*b* of the bases 4*a* of the inner body 4 are dimension-wise equal to one third of the length of the hypotenuse of the triangles defining the bases of the first prismatic bodies 3, as brought out by FIG. 4. The corner edges 4*c* of the lateral surface of the inner body 4 have instead a length dimension equal to the height of each of the first prismatic bodies 3. The overall form of the inner body 4 closely approximates that of a cube.

With the block 2 in the assembled condition, the inner body 4 is almost concealed from view because, as shown in FIG. 4, it has a lateral face lying on said first section plane, crosswise to the block 2, and the remaining faces engaged by said second prismatic bodies. Two corner edges 4*c* only, belonging to the lateral face of the inner body 4 opposed to that lying on the first section plane, will lie on the lateral surface of the block 2.

Other embodiments of the inventive game provide for variations in the shape of the inner body 4 as relates to the bases 4*a*, which may be mere rectangles. Moreover, where the block 2 has a main extension in the direction of the corner edges 2*c*, several inner bodies 4 may be provided.

The second prismatic bodies 5,6 are defined, in the preferred embodiment shown in the drawings, by eight portions 1 of the block 2. All of the second prismatic bodies 5,6 are fashioned as right prisms having isosceles right triangle bases and a height which is equal to or a submultiple of the height of each of the first prismatic bodies 3.

In particular, the second prismatic bodies are divided into complementary bodies 5 and auxiliary bodies 6.

Again in the preferred embodiment shown in the drawing views, the complementary bodies 5 are four in number and together adapted to form, with the inner body 4, a shape which is the same as that of each first prismatic body 3. In particular, the complementary bodies 5 comprise a pair of identical lateral prisms 7 having a height 7*c* which is equal to that of the inner body 4 and being located on opposite faces of the inner body 4. As shown in FIG. 4, illustrating bases 7*a* of the lateral prisms 7, the latter have a lateral surface bounded by the outer surface of the block 2, said first section plane containing two opposed corner edges of the block 2, and a lateral face of the inner body 4. The catheti 7*b* of said bases 7*a*, in the form of isosceles right triangles, have the same length as the sides 4*b* of the inner body 4 and equal to one third of the length of the hypotenuses of the isosceles right triangles defining the bases 3*a* of the first prismatic bodies 3. It may be noted that as the lateral prisms 7 are brought to match, they define a volume equal to that of the inner body 4, of which they may also duplicate the form.

Also included with the complementary bodies 5 are two identical vertex prisms 8 having a height 8*c* which is equal to one half the height of the inner body 4, and bases 8*a* in the form of an isosceles right triangle whose area is equal to one half the area of each base of the lateral prisms 7. The catheti 8*b* of said bases 8*a* have a length dimension equal to one third the length dimension of the catheti of the bases of the first prismatic bodies 3 (FIG. 4). The hypotenuse of the bases 8*a* has instead the same length as the sides 4*b* of the inner body 4. Volume-wise, the two vertex prisms 8 are the equivalent of one lateral prism 7.

In the instance of modified embodiments with respect to that shown, the complementary bodies 5 may have various shapes and dimensions related to the shape of the inner body 4. However, they would in all cases be defined by triangular-base right prisms, and particularly the lateral prisms 7 would invariably have right triangle bases, whilst one or more vertex prisms 8 would be provided which have isosceles triangle bases.

Figure 5:
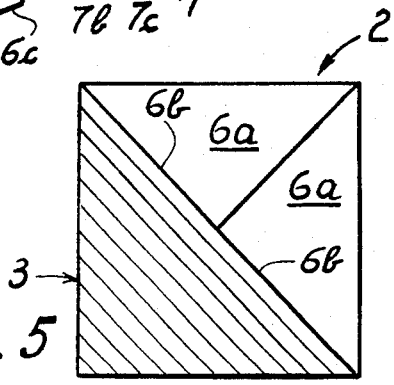
Figure 6:
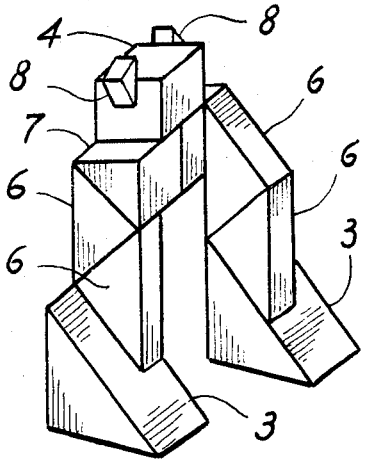
FIGS. 6 to 12 show some examples of the three-dimensional configurations to be achieved with this didactic game.
Figure 7:
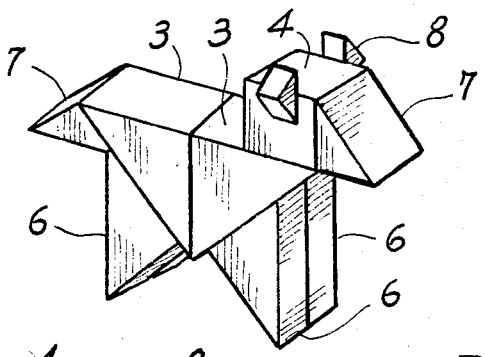
Figure 8:
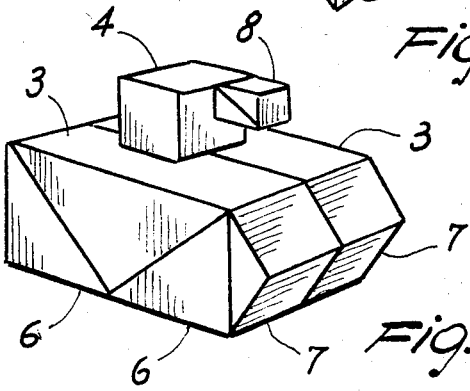
Figure 9:
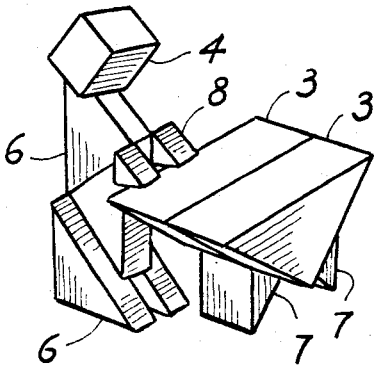
Figure 10:
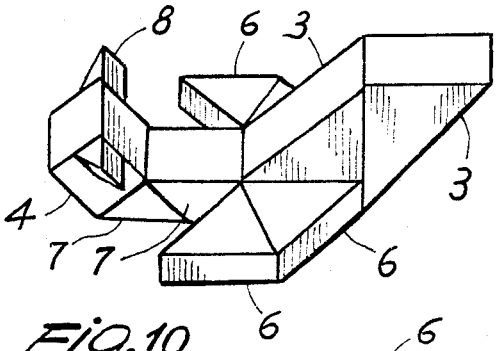
Figure 11:
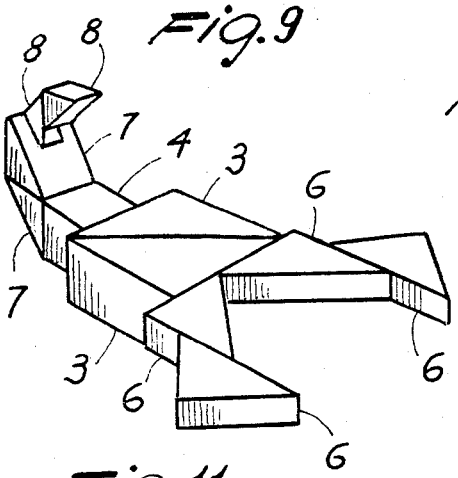
Figure 12:
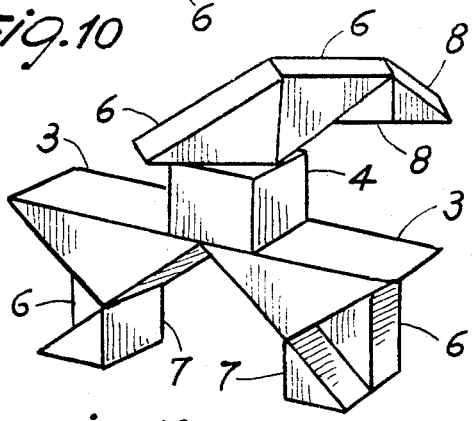

The second prismatic bodies further comprise the cited auxiliary bodies 6. The latter are preferably four in number, with bases 6*a* defined by isosceles right triangles whose area is equal to one half the area of the bases of the first prismatic bodies 3 and whose catheti 6*b* are half as long as the hypotenuse of the bases of the first prismatic bodies 3 (FIG. 5). The corner edges 6*c* of the lateral surface of the auxiliary bodies 6, which are coincident with the height dimension thereof, have a length equal to one half the height of the first prismatic bodies 3. Taken together, the four auxiliary bodies 6 define a volume which is the equal of that of one first prismatic body 3, of which they may also duplicate the form.

With different embodiments from the preferred one, the auxiliary bodies 6 will still have a height which is a submultiple of that the first prismatic bodies 3.

The cited portions of the block 2 are detachably engageable together through connection elements which may vary also in conformity with the material used to form the block 2, i.e. whether wood, plastics, or metal. These connection elements may be, as an example, magnetic elements arranged at each of said portions, or surface interlocking elements. The magnetic elements may be cores embedded in the portions 1, or strips applied to the surfaces to be joined together. The interlocking elements may be small pegs separated by recesses adapted to receive other like pegs therein. In the drawings, the portions of the block 2 are shown to be smooth because the use of connection elements of the magnetic type has been assumed.

With the inventive didactic game, it is advantageously possible to restrict the arrangement of connection elements to the lateral surfaces of the cited prismatic bodies, leaving said bases out. A great many three-dimensional configurations is, in fact, feasible by merely engaging said lateral surfaces together, as shown in FIGS. 6 to 12.

Thus, it becomes possible to provide the cited portions 1 with hollow construction portions: for example, at least those portions 1 which are defined by triangular base prisms may be constructed with lateral surfaces and inner stiffening members, such as ribs, diaphragms, rods, or the like. Such hollow construction portions would not detract from the game appearance and three-dimensionality, while lowering its cost to an appreciable extent because material consumption would be reduced and because the molding or piece forming operations would be simplified. Any interlocking provisions, moreover, could be simply defined by ribs or grooves formed on said lateral surfaces perpendicularly to said bases.

The use of the didactic game just described is quite apparent.

FIGS. 6 to 12 illustrate some exemplary figures to be obtained by juxtaposing the individual portions which make up the block 2.

Subdivision of the block 2 into the portions 1 described hereinabove is the outcome of a research directed to increase the range of figures and objects that may be formed therefrom. The inner body 4, in particular, is suited to shaping the head or trunk of human-like or animal-like figures. With other compositions, it would form the base for the prismatic bodies with its six faces. The prismatic bodies are subdivided into a range of sizes to facilitate assembling of complex configurations. For example, the first prismatic bodies 3, which are larger, may provide stands, animal bodies, houses, and anything else which involves large-size elements. The auxiliary bodies 6, defined by four equal pieces, may provide structures which involve the availability of at least four pieces, such as animal legs, flower petals, or abstract elements requiring continuity, such as towers, implements, rods, etc. The complementary bodies 5, of smaller size, provide ideal connection elements for interconnecting the various pieces. Furthermore, the vertex prisms 8, which form the smallest portions of the block 2, may be finishing elements in a complex structure, such as antennae or arms of a robot, the ears of an anthropomorphic figure, and so forth.

The invention is susceptible to many changes and modifications without departing from the purview of the instant inventive concept.

Materials and dimensions may be selected contingent on individual applicational requirements.

I claim:

1. A didactic game defined by a block subdivided into suitable portions to compose three-dimensional figures, characterized in that said block is generally fashioned after a quadrangular prism having for its bases equal-sided parallelograms, and in that said portions comprise: first prismatic bodies identical to one another and defining together a volume at least close to one half the volume of said block and being configured as right prisms having isosceles triangle bases, said first prismatic bodies being bounded by the outer surface of said block, a first section plane containing two opposed corner edges of the lateral surface of said quadrangular prism, and at least one second section plane extending perpendicular to said corner edges and parallel to said isosceles triangle bases, second prismatic bodies fashioned as right prisms with triangular bases extending parallel to the bases of said first prismatic bodies and to a height equal to or being a submultiple of the height of each of said first prismatic bodies, and at least one inner body in the form of a right parallelepipedon having rectangular bases extending parallel to the bases of said first prismatic bodies and the same height as each of said first prismatic bodies, said inner body having a lateral face lying on said first section plane and the lateral corner edges of the opposed lateral face lying on the surface of said block.

2. A didactic game according to claim 1, characterized in that said quadrangular prism defining the overall form of said block is a right prism.

3. A didactic game according to claim 1, characterized in that said equal-sided parallelograms forming the bases of said block are squares.

4. A didactic game according to claim 1, characterized in that said block is fashioned after a right prism and has for its bases equal-sided parallelograms defined by squares, and in that the height of said block is equal to the length of said sides, said block being a cube.

5. A didactic game according to claim 1, characterized in that said second prismatic bodies comprise auxiliary bodies whose height is a submultiple of the height of said first prismatic bodies, and complementary bodies adapted to form with one said inner body an identical configuration to the configuration of one said first prismatic body.

6. A didactic game according to claim 5, characterized in that said auxiliary bodies have a height dimension equal to one half the height dimension of said first prismatic bodies and bases defined by triangles, the area of each of said triangles being equal to one half the area of one base of said first prismatic bodies.

7. A didactic game according to claim 5, characterized in that said quadrangular prism defining the overall configuration of said block is a right prism, and in that the same is formed by two of said first prismatic bodies having a combined volume equal to one half the volume of said block, one said inner body, four of said complementary bodies in mutually identical pairs and adapted to define together with said inner body the volume of one said first prismatic body, and four of said auxiliary bodies being all identical to one another and adapted to define the volume of one said first prismatic body.

8. A didactic game according to claim 7, characterized in that said block is defined by a right prism whose equal-sided parallelogram bases are squares, and in that said first and second prismatic bodies have for their bases isosceles right triangles and said inner body has for its bases two squares.

9. A didactic game according to claim 1, characterized in that each of said portions where into said block is subdivided is provided with connection elements adapted to allow releasable engagement with the remaining portions of said block.

10. A didactic game according to claim 9, characterized in that each of said portions in the form of a triangular base prism has said connection elements arranged at the lateral faces of said triangular prism.

11. A didactic game according to claim 9, characterized in that said connection elements are of a magnetic type.

12. A didactic game according to claim 9, characterized in that said connection elements are defined by surface interlocking formations.

13. A didactic game according to claim 10, characterized in that said portions in the form of triangular base prisms are hollow and defined by the lateral surfaces of said portions and inner stiffening elements.

* * * * *